US006925986B2

(12) United States Patent
Cannone et al.

(10) Patent No.: US 6,925,986 B2
(45) Date of Patent: Aug. 9, 2005

(54) SERVO-ASSISTED BUTTERFLY VALVE FOR AN INTERNAL COMBUSTION ENGINE PROVIDED WITH AN ADJUSTMENT SYSTEM FOR THE LIMP-HOME POSITION

(75) Inventors: Domenico Cannone, Bologna (IT); Gianni Fargnoli, Anzola Emilia (IT)

(73) Assignee: Magneti Marelli Powertrain, S.p.A. (IT)

( * ) Notice: Subject to any disclaimer, the term of this patent is extended or adjusted under 35 U.S.C. 154(b) by 0 days.

(21) Appl. No.: 10/763,769

(22) Filed: Jan. 22, 2004

(65) Prior Publication Data

US 2004/0226538 A1 Nov. 18, 2004

(30) Foreign Application Priority Data

Jan. 24, 2003 (IT) ..... BO2003A0033

(51) Int. Cl.[7] ..... F02D 7/00
(52) U.S. Cl. ..... 123/396; 123/398
(58) Field of Search ..... 123/396, 397, 123/398, 400; 251/69

(56) References Cited

U.S. PATENT DOCUMENTS 6,253,732 B1 * 7/2001 Semeyn et al. ..... 123/396
6,267,352 B1 * 7/2001 Semeyn et al. ..... 251/129.12
6,386,178 B1 * 5/2002 Rauch ..... 123/337
6,622,984 B2 * 9/2003 Rauch et al. ..... 251/71

* cited by examiner

*Primary Examiner*—Mahmoud Gimie
(74) *Attorney, Agent, or Firm*—Ostrolenk, Faber, Gerb & Soffen, LLP

(57) ABSTRACT

A servo-assisted butterfly valve for an internal combustion engine comprising a valve seat, a butterfly body engaging the valve seat, a shaft on which the butterfly body is keyed, an electric actuator coupled to the shaft, an elastic member which is adapted to exert a torque on the shaft which tends to rotate the butterfly body towards a limp-home position and an abutment body which comprises an eccentric member which forms an abutment surface for an abutment member of the elastic body in order to stop, in the desired limp-home position, the rotation of the butterfly body caused by the elastic body in the absence of action by the electric actuator.

10 Claims, 3 Drawing Sheets

SERVO-ASSISTED BUTTERFLY VALVE FOR AN INTERNAL COMBUSTION ENGINE PROVIDED WITH AN ADJUSTMENT SYSTEM FOR THE LIMP-HOME POSITION

The present invention relates to a servo-assisted butterfly valve for an internal combustion engine provided with an adjustment system for the limp-home position.

BACKGROUND OF THE INVENTION

In an internal combustion engine, the function of a butterfly valve is to regulate the flow of fresh air supplied to the cylinders; normally, a butterfly valve has a valve body housing a valve seat engaged by a butterfly body which is keyed on a shaft in order to rotate between an open and a closed position of the valve seat under the action of an electric actuator coupled to this shaft by means of a gear transmission. An elastic body (typically formed by a double spring) is also coupled to the shaft and exerts a torque on the shaft which tends to rotate the butterfly body towards the open position and which, in the absence of action by the electric actuator, causes the butterfly body to be disposed in a partially open position (commonly known as the limp-home position) as a result of the presence of an abutment surface which forms an abutment for the elastic body against which the opening movement caused by this elastic body is stopped.

Currently, the abutment surface is formed by a support body which is obtained by casting on the crude valve body; however, the sum of the tolerances in respect of the casting work, the joint molding of the shaft, the diameter of the butterfly body and the diameter of the valve seat cause a total air flow dispersion in the limp-home position of approximately ±18–20%. In some applications, this total air flow dispersion value in the limp-home position is too high; it has therefore been proposed to carry out precision machining of the support body, which precision machining makes it possible to reduce the total air flow dispersion in the limp-home position to approximately ±10–12%.

However, this precision machining is particularly costly and in any case does not make it possible to obtain a total air flow dispersion value in the limp-home position of less than ±10%. Moreover, in order significantly to vary the value of the air flow in the limp-home position (typically to be able to adapt the butterfly valve to different types of engine) it is necessary to modify the casting mould to vary the position of the support body; in general, a specific valve body and therefore a specific mould is required for each flow value, which obviously increases production costs.

In order to try further to reduce the total air flow dispersion value in the limp-home position, it has been proposed to replace the support body with a screw which is screwed through the valve body and has a head disposed outside this valve body and a free end forming the abutment surface against which the elastic body comes to abut. During the production stage, each butterfly valve is disposed on a test bench, where the value of the air flow in the limp-home position is measured in real time; in these circumstances, the axial position of the screw is adjusted by screwing or unscrewing the screw with respect to the valve body until the desired value of the air flow in the limp-home position is accurately obtained. Preferably, once the axial position of the screw has been adjusted, the screw is locked with respect to the valve body to prevent any subsequent displacement (typically as a result of the vibrations generated by the operation of the engine).

The use of a through screw does not make it possible, however, significantly to vary the air flow value in the limp-home position without modifying the casting mould.

FR2781525 discloses a motorized throttle butterfly with limp-home facility for use in motor vehicles and having a spring with two torsion zones on either side of bolt to set throttle in limp-home position; the first zone has its end connected to the throttle housing, and the second zone has its end coupled to a support fixed to the butterfly spindle. The two spring zones are on either side of a bolt that when engaged sets the throttle in the limp-home position.

EP1148225 discloses a throttle return mechanism for an electronically controlled throttle that provides for the precise setting of a limp home throttle blade position. The throttle return mechanism includes a return spring with two legs attached to a fixed shaft, and a bracket, which is attached to a drive mechanism and includes stops that engage the return spring as the bracket rotates about the fixed shaft; each stop is cam shaped and rotatable to provide for adjustment of the limp home throttle blade setting. When the drive mechanism is disabled the legs of the return spring will engage the stops on the bracket and rotate the throttle blade to the limp home position; the second leg of the return spring will rotate and hold the throttle valve in a limp home throttle position to allow a driver to maneuver the motor vehicle.

SUMMARY OF THE INVENTION

The object of the present invention is to provide a servo-assisted butterfly valve for an internal combustion engine provided with an adjustment system for the limp-home position, which is free from the above-described drawbacks and which is easy and economic to produce.

The present invention therefore relates to a servo-assisted butterfly valve for an internal combustion engine provided with an adjustment system for the limp-home position as set out in claim 1.

BRIEF DESCRIPTION OF THE DRAWINGS

The invention will now be described with reference to the accompanying drawings, which show a non-limiting embodiment thereof, and in which.

DETAILED DESCRIPTION OF THE INVENTION

Figure 1:
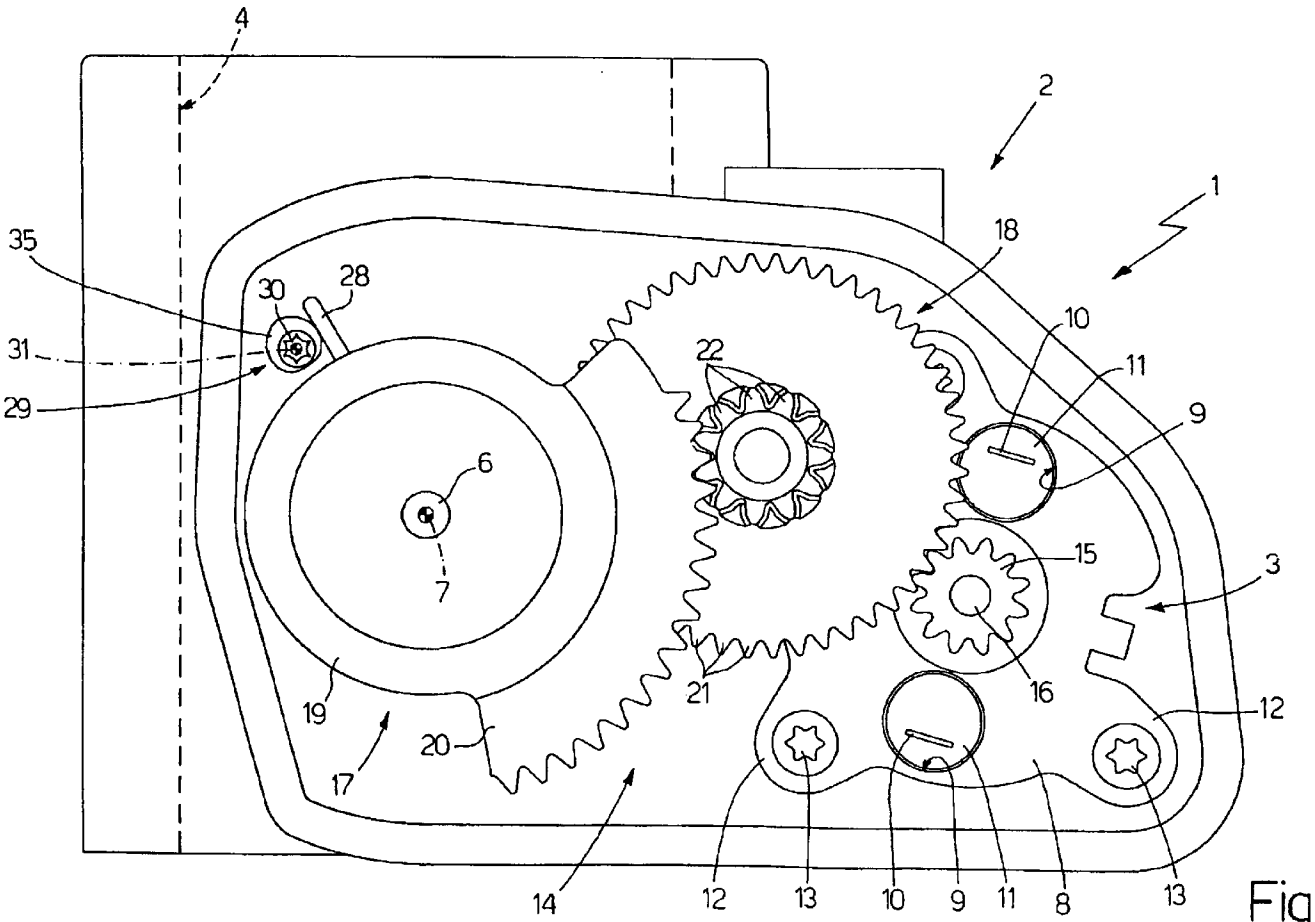
FIG. 1 is a front, diagrammatic view, with some parts removed for clarity, of a servo-assisted butterfly valve for an internal combustion engine of the present invention.

In FIG. 1, a servo-assisted butterfly valve for an internal combustion engine is shown overall by 1; the butterfly valve 1 comprises a valve body 2 which houses an electric actuator 3, a cylindrical valve seat 4 and a butterfly body 5 (shown in FIG. 2) which engages the valve seat 4 and moves between an open position and a closed position of this valve seat 4 under the action of the electric actuator 3. The butterfly body 5 is keyed on a metal shaft 6 which is mounted on the valve body 2 in order to rotate about a longitudinal axis 7 as a result of the action of the electric actuator 3 in order to displace the butterfly body 5 between the above-mentioned open and closed positions of the valve seat 4.

The electric actuator 3 is mounted on a metal plate 8 provided with a pair of through holes 9 via which two electrical conductors 10, supplying electrical energy to the electric actuator 3, pass; a respective insulating bushing 11 is interposed between each electrical conductor 10 and the respective hole 9 of the plate 8. The main function of the plate 8 is to enable the electric actuator 3 to be secured to the valve body 2; for this purpose, the plate 8 has three drilled radial projections 12 via which respective screws 13 for fastening to the valve body 2 are inserted.

The electric actuator 3 transmits movement to the shaft 6 via a gear transmission 14 which comprises a toothed wheel 15 keyed on the shaft 16 of the electric actuator 3, a toothed wheel 17 keyed on the shaft 6, and an idle toothed wheel 18 interposed between the toothed wheel 15 and the toothed wheel 17. The toothed wheel 17 has a solid central cylindrical body 19 which is keyed on the shaft 6 and is provided with a circular crown portion 20 which has a series of teeth coupled to the toothed wheel 18. The toothed wheel 18 has a first series of teeth 21 coupled to the toothed wheel 15 and a second series of teeth 22 coupled to the toothed wheel 17; the diameter of the first series of teeth 21 is different from the diameter of the second series of teeth 22 and therefore the toothed wheel 18 has a non-unitary transmission ratio. Normally, the toothed wheel 17 and the toothed wheel 18 are made from plastic material, while the toothed wheel 15 is made from metal material.

Figure 2:
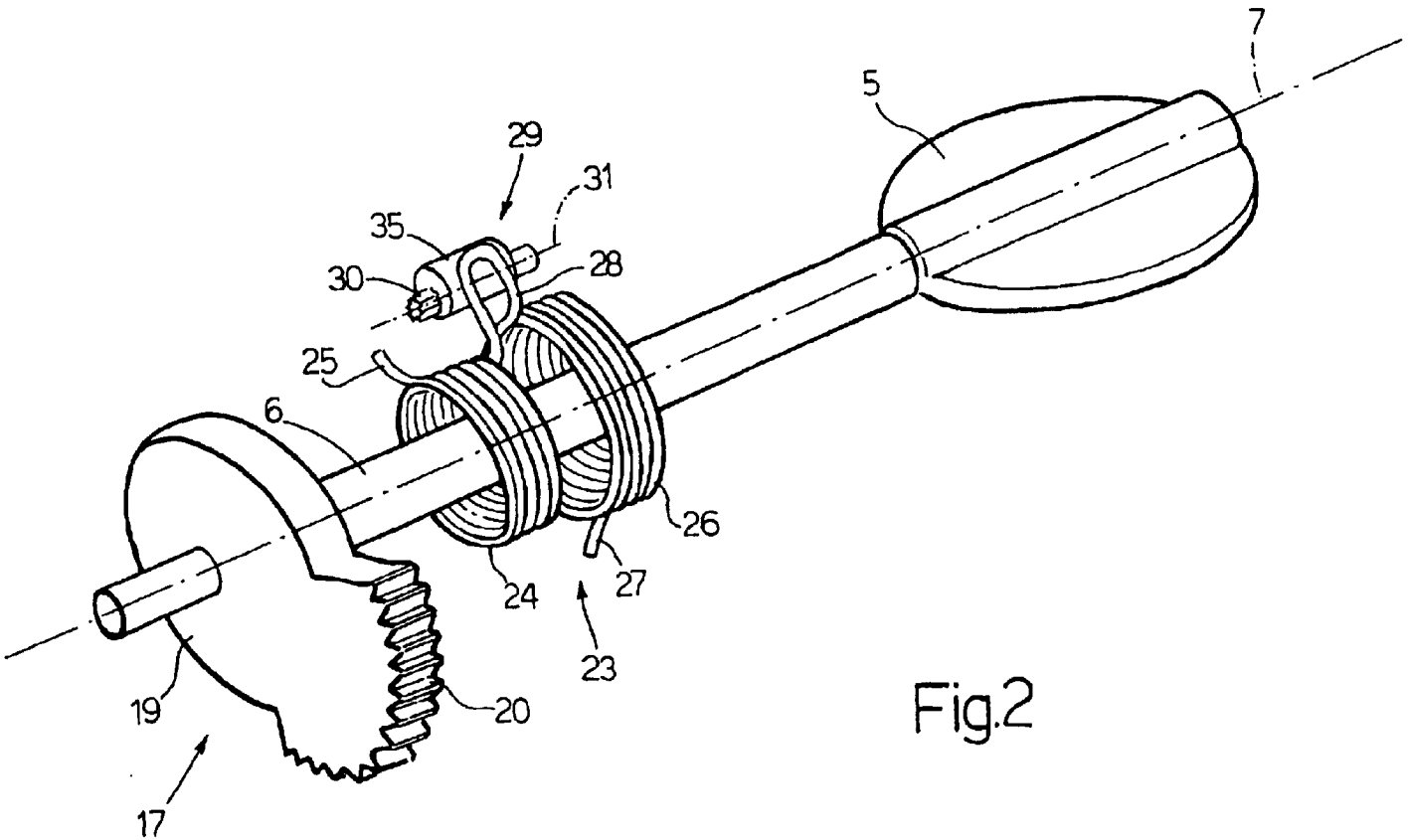
FIG. 2 is a perspective, exploded view of a detail of FIG. 1.

As shown in FIG. 2, a double spring 23 is coupled to the shaft 6 and has a front spring 24 provided with a first projection 25 coupled mechanically to the toothed wheel 17 (and therefore to the shaft 6) and a rear spring 26 provided with a projection 27 coupled mechanically to the valve body 2. The front spring 24 and the rear spring 26 are connected together by a curved member 28 which, in operation, is normally in abutment on an abutment body 29.

The front spring 24 tends to rotate the shaft 6 in the clockwise direction with a movement which tends to bring the butterfly body 5 into the above-mentioned closed position, while the rear spring 26 tends to rotate the shaft 6 in the anti-clockwise direction with a movement which tends to bring the butterfly body 5 into the above-mentioned open position; the front spring 24 generates an elastic torque lower than the elastic torque generated by the rear spring 26, with the result that, overall, the double spring 23 tends to rotate the shaft 6 in the anti-clockwise direction. The anti-clockwise rotation (i.e. towards the open position) of the shaft 6 under the action of the double spring 23 is blocked by the presence of the abutment body 29 which forms an abutment surface against which the curved member 28 comes to abut; in this way, in the absence of action by the electric actuator 3, the double spring 23 brings the shaft 6 (and therefore the butterfly body 5) into a partially open or limp-home position.

When the electric actuator 3 is actuated, the drive torque generated by this electric actuator 3 on its shaft 16 is adapted to rotate the shaft 6 (and therefore the butterfly body 5) into the above-mentioned closed position against the elastic torque of the rear spring 26 and is adapted to rotate the shaft 6 (and therefore the butterfly body 5) into the above-mentioned open position against the elastic torque of the front spring 24.

Figure 3:
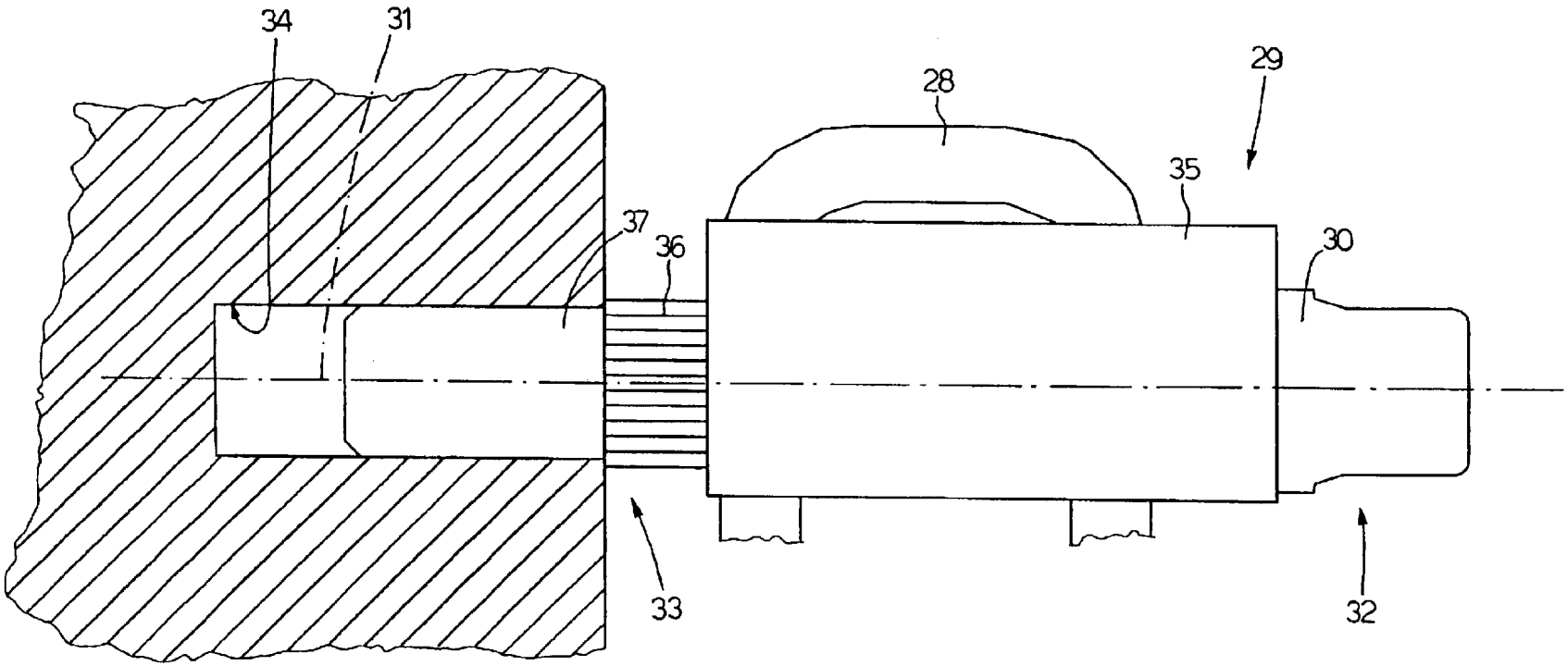
FIG. 3 is a side view, in cross-section and on an enlarged scale, of a further detail of FIG. 1.

As shown in FIGS. 2 and 3, the abutment body 29 comprises a cylindrical pin 30 which is mounted to rotate about its own central axis 31 parallel to the axis 7; the cylindrical pin 30 in particular has a free front end 32 which can be engaged by an operator by means of a spanner or screwdriver, and a rear end 33 opposite the front end 32 and inserted in a blind housing hole 34 so as to be able to rotate with respect to this housing hole 34. Between the front end 32 and the rear end 33, the pin 30 is coupled to an eccentric member 35 which is eccentric with respect to the axis 31.

It will be appreciated that by rotating the pin 30, i.e. by rotating the abutment body 29, about the axis 31, the eccentric member 35 is caused to rotate thereby obtaining a variation of the position of the abutment surface against which the curved member 28 abuts; in this way it is possible accurately to set the position of the abutment surface against which the curved member 28 abuts and therefore the flow of air in the limp-home position.

During the production stage, the butterfly valve 1 is disposed in a test bench (known and not shown) in which the value of the air flow in the limp-home position is measured in real time; in these circumstances, the angular position of the abutment body 29 is adjusted by rotating the pin 30 about the axis 31 until the desired air flow value in the limp-home position is accurately obtained. Preferably, once the angular position of the abutment body 29 has been set, the abutment body 29 is locked with respect to the valve body 2 to prevent any subsequent displacement (typically as a result of the vibrations generated by the operation of the engine).

The rear end 33 of the pin 30 comprises a knurled portion 36 which has a diameter slightly greater than the diameter of the housing hole 34, and a smooth portion 37 which has a diameter substantially equal to the diameter of the housing hole 34. When the abutment body 29 is coupled to the valve body 2, only the smooth portion 37 of the rear end 33 of the pin 30 is inserted into the housing hole 34 so that the pin 30 can rotate with respect to the housing hole 34; in order permanently to lock the position of the pin 30 relative to the hole 2, the pin 30 is hammered so that the knurled portion 36 is also driven into and locked in the housing hole 34.

The above-described use of the abutment body 29 comprising the eccentric member 35 enables a very fine adjustment of the air flow in the limp-home position and is very simple and economic to produce. Moreover, it is very simple to obtain different air flow values in the limp-home position without in any way modifying the casting mould; in practice, it is enough to vary the position of the housing hole 34, which is produced by drilling the valve body 2 after this valve body has been cast.

In summary, the above-described solution provides the following advantages: recovery of the dispersions resulting from the tolerances of the various components which play a part in defining the value of the air flow in the limp-home position without the need to use precision machining, the possibility of readily obtaining different air flow values in the limp-home position simply by moving the position of the housing hole 34 and a guarantee that the setting can be maintained in operation even in the case of thermal shocks or vibrations as a result of the locking of the knurled portion 36 in the housing hole 34.

What is claimed is:

1. A servo-assisted butterfly valve (1) for an internal combustion engine comprising:

a valve body (2), a valve seat (4) defined in the valve body (2), a butterfly body (5) adapted to engage the valve seat (4), a shaft (6) on which the butterfly body (5) is keyed and housed by the valve body (2), an electric actuator (3) coupled to the shaft (6) in order to rotate the butterfly body (5) between an open and a closed position of the valve seat (4), an elastic body (23) which is adapted to exert a torque on the shaft (6) which tends to rotate the butterfly body (5) towards a limp-home position and an abutment body (29) which forms an abutment surface for an abutment member (28) of the elastic body (23) in order to stop, in the desired limp-home position, the rotation of the butterfly body (5) caused by the elastic body (23) in the absence of action by the electric actuator (3); wherein the abutment body (29) comprises an eccentric member (35) which is adapted to rotate with respect to the valve body (2) with a predetermined eccentricity about an adjustment axis (31);

wherein the elastic body (23) comprises a first spring (24) provided with a first projection (25) coupled mechanically to the shaft (6) and a second spring (26) provided with a projection (27) coupled mechanically to the valve body (2), the first and second springs (24, 26) being connected together by a curved member (28) which forms the abutment member (28).

2. A valve (1) as claimed in claim 1, in which the first front spring (24) tends to rotate the shaft (6) with a movement which tends to bring the butterfly body (5) into the closed position, and the second spring (26) tends to rotate the shaft (6) with a movement which tends to bring the butterfly body (5) into the open position, the first spring (24) generating an elastic torque lower than the elastic torque generated by the second spring (26).

3. A valve (1) as claimed in claims 1, in which the abutment body (29) comprises a cylindrical pin (30) which is mounted on the valve body (2) in order to rotate about an adjustment axis (31) and has a free front end (32) and a rear end (33) inserted in a blind housing hole (34) provided in the valve body (2).

4. A valve (1) as claimed in claim 3, in which the rear end (33) of the pin (30) has a smooth portion (37) whose diameter is substantially equal to the diameter of the housing hole (34) and a knurled portion (36) whose diameter is slightly greater than the diameter of the housing hole (34), only the smooth portion (37) of the rear end (33) of the pin (30) initially being inserted in the housing hole (34).

5. A valve (1) as claimed in claim 4, in which the knurled portion (36) of the rear end (33) of the pin (30) is adapted to be driven into the housing hole (34) in order to lock the angular position of the pin (30) with respect to the valve body (2).

6. A valve (1) as claimed in claims 3, in which the valve body (2) is shaped so as to enable the provision of the housing hole (34) in different positions in order to obtain different air flow values in the limp-home position.

7. A servo-assisted butterfly valve (1) for an internal combustion engine comprising:

a valve body (2), a valve seat (4) defined in the valve body (2), a butterfly body (5) adapted to engage the valve seat (4), a shaft (6) on which the butterfly body (5) is keyed and housed by the valve body (2), an electric actuator (3) coupled to the shaft (6) in order to rotate the butterfly body (5) between an open and a closed position of the valve seat (4), an elastic body (23) which is adapted to exert a torque on the shaft (6) which tends to rotate the butterfly body (5) towards a limp-home position and an abutment body (29) which forms an abutment surface for an abutment member (28) of the elastic body (23) in order to stop, in the desired limp-home position, the rotation of the butterfly body (5) caused by the elastic body (23) in the absence of action by the electric actuator (3); wherein the abutment body (29) comprises an eccentric member (35), which is adapted to rotate with respect to the valve body (2) with a predetermined eccentricity about an adjustment axis (31), and a cylindrical pin (30), which is mounted on the valve body (2) in order to rotate about the adjustment axis (31) and has a free front end (32) and a rear end (33) inserted in a blind housing hole (34) provided in the valve body (2); wherein the elastic body (23) comprises a first spring (24) provided with a first projection (25) coupled mechanically to the shaft (6) and a second spring (26) provided with a projection (27) coupled mechanically to the valve body (2), the first and second springs (24, 26) being connected together by a curved member (28) which forms the abutment member (28).

8. A valve (1) as claimed in claim 7, in which the rear end (33) of the pin (30) has a smooth portion (37) whose diameter is substantially equal to the diameter of the housing hole (34) and a knurled portion (36) whose diameter is slightly greater than the diameter of the housing hole (34), only the smooth portion (37) of the rear end (33) of the pin (30) initially being inserted in the housing hole (34).

9. A valve (1) as claimed in claim 8, in which the knurled portion (36) of the rear end (33) of the pin (30) is adapted to be driven into the housing hole (34) in order to lock the angular position of the pin (30) with respect to the valve body (2).

10. A valve (1) as claimed in claim 7, in which the valve body (2) is shaped so as to enable the provision of the housing hole (34) in different positions in order to obtain different air flow values in the limp-home position.

* * * * *